US006521580B2

(12) United States Patent
Perry et al.

(10) Patent No.: US 6,521,580 B2
(45) Date of Patent: Feb. 18, 2003

(54) SILOXANE DRY CLEANING COMPOSITION AND PROCESS

(75) Inventors: Robert J. Perry, Niskayuna, NY (US); Donna Ann Riccio, Watervliet, NY (US); Larry D. Ryan, Waterford, NY (US)

(73) Assignee: General Electric Company, Pittsfield, MA (US)

( * ) Notice: Subject to any disclaimer, the term of this patent is extended or adjusted under 35 U.S.C. 154(b) by 0 days.

(21) Appl. No.: 09/730,816

(22) Filed: Dec. 6, 2000

(65) Prior Publication Data

US 2002/0115582 A1 Aug. 22, 2002

Related U.S. Application Data

(60) Provisional application No. 60/184,108, filed on Feb. 22, 2000.

(51) Int. Cl.[7] ..... D06L 1/62
(52) U.S. Cl. ..... 510/285
(58) Field of Search ..... 510/285, 289

(56) References Cited

U.S. PATENT DOCUMENTS

| | | | | |
|---|---|---|---|---|
| 4,005,231 A | | 1/1977 | Smith | |
| 4,065,258 A | | 12/1977 | France | |
| 4,685,930 A | | 8/1987 | Kasprzak | |
| 4,911,853 A | | 3/1990 | Coffindaffer et al. | |
| 5,036,108 A | * | 7/1991 | Asahi et al. | 514/937 |
| 5,449,519 A | * | 9/1995 | Wolf et al. | 424/401 |
| 5,518,716 A | * | 5/1996 | Riccio et al. | 424/70.1 |
| 5,545,344 A | * | 8/1996 | Durbut et al. | 510/223 |
| 5,676,705 A | | 10/1997 | Jureller et al. | |
| 5,681,808 A | * | 10/1997 | Kobayashi et al. | 510/511 |
| 5,693,602 A | * | 12/1997 | Draiper et al. | 510/224 |
| 5,698,510 A | * | 12/1997 | Wilkinson et al. | 510/444 |
| 5,865,852 A | | 2/1999 | Berndt | |
| 5,942,007 A | | 8/1999 | Berndt et al. | |
| 5,977,040 A | * | 11/1999 | Inada et al. | 510/165 |
| 6,042,617 A | | 3/2000 | Berndt | |
| 6,042,618 A | | 3/2000 | Berndt et al. | |
| 6,056,789 A | | 5/2000 | Berndt et al. | |
| 6,059,845 A | | 5/2000 | Berndt et al. | |
| 6,063,135 A | | 5/2000 | Berndt et al. | |
| 6,156,718 A | * | 12/2000 | Donoghue et al. | 510/444 |

FOREIGN PATENT DOCUMENTS

| | | |
|---|---|---|
| DE | 37 39 7111 A | 6/1989 |
| EP | 0 458 969 A | 12/1991 |
| EP | 1 041 189 | 10/2000 |
| EP | 1 043 443 | 10/2000 |
| EP | 1 092 803 A | 4/2001 |
| JP | 06327888 | 11/1994 |
| JP | 09299687 | 11/1997 |
| WO | WO 94/01510 | 1/1994 |
| WO | 01 94684 A | 12/2001 |

OTHER PUBLICATIONS

Database WPI; Section Ch, Week 198201 Derwent Publication Ltd., London, GB; Class D25, An 1982–00888E Dec. 1, 1981 abstract.
Chemical Marketing Reporter (newspaper), Dec. 15, 1997 issue, p. 15.

* cited by examiner

*Primary Examiner*—John Hardee
(74) *Attorney, Agent, or Firm*—Kenneth S. Wheelock

(57) ABSTRACT

A dry cleaning composition comprising a volatile siloxane and an organic surfactant and, optionally water, and a method for dry cleaning comprising contacting an article with a composition comprising a volatile siloxane and an organic surfactant.

2 Claims, No Drawings

SILOXANE DRY CLEANING COMPOSITION AND PROCESS

CROSS-REFERENCE TO RELATED APPLICATIONS

This application claims rights of priority from U.S. Provisional Patent Application Ser. No. 60/184,108, filed Feb. 22, 2000.

TECHNICAL FIELD

The present invention is directed to a dry cleaning composition, more specifically, to a siloxane fluid based composition, for use in dry cleaning and to a dry cleaning process using the composition.

BACKGROUND

Current dry cleaning technology uses perchloroethylene ("PERC") or petroleum-based materials as the cleaning solvent. PERC suffers from toxicity and odor issues. The petroleum-based products are not as effective as PERC in cleaning garments.

Cyclic siloxanes have been reported as spot cleaning solutions, see U.S. Pat. No. 4,685,930, and as dry cleaning fluids in dry cleaning machines, see U.S. Pat. No. 5,942,007. Other patents disclose the use of silicone soaps in petroleum solvents, see JP 09299687, and the use of silicone surfactants in super critical carbon dioxide solutions has been reported, see, for example, U.S. Pat. No. 5,676,705 and Chem. Mark. Rep., Dec. 15, 1997, 252(24), p. 15. Non-volatile silicone oils have also been used as the cleaning solvent requiring removal by a second washing with perfluoroalkane to remove the silicone oil, see JP 06327888.

Numerous other patents have issued in which siloxanes or organomodified silicones have been present as addenda in PERC or petroleum based dry cleaning solvents, see, for example, WO 9401510; U.S. Pat. Nos. 4,911,853; 4,005,231; 4,065,258.

There is a continued interest in providing an additive or additives to enhance the cleaning ability of silicone based dry cleaning solvents.

SUMMARY OF THE INVENTION

In a first aspect, the present invention is directed to a dry cleaning composition, comprising a volatile cyclic, linear or branched siloxane and one or more organic surfactants.

In a second aspect, the present invention is directed to a method for dry cleaning an article, comprising contacting the article with a composition comprising a cyclic, linear or branched siloxane and an organic surfactant which may be chosen from the classes of nonionic, cationic, anionic or amphoteric.

The process of the present invention exhibits improved performance, such as for example, removal of water soluble stains from the article, for example a garment, being cleaned. The process of the present invention also effectively removes most soluble stains, including oil stains and grease stains.

DETAILED DESCRIPTION OF THE INVENTION

In a preferred embodiment, the composition comprises, based on 100 parts by weight ("pbw") of the composition, from greater than 90 pbw to 99.99 pbw, more preferably from 92 pbw to 99.9 pbw and even more preferably from 95 pbw to 99.5 pbw of the siloxane and from 0.001 pbw to less than 10 pbw, more preferably from 0.01 pbw to 8 pbw and even more preferably from 0.1 pbw to 5 pbw of the surfactant. The composition optionally further comprises water, preferably from 0.01 pbw to 15 pbw, more preferably from 0.1 pbw to less than 12 pbw and even more preferably from 0.2 pbw to 10 pbw of water. Preferably, the composition does not include siloxane resins or crosslinking agents.

In a preferred embodiment, the water may be added as "free" water or may be delivered by an emulsion containing other components such as siloxanes, hydrocarbons, surfactants, or other suitable additives. If the water is delivered by an emulsion, the emulsion may be prepared by either homogenization of the components or by mechanically stirring the mixture.

Compounds suitable as the linear or branched, volatile siloxane solvent of the present invention are those containing a polysiloxane structure that includes from 2 to 20 silicon atoms. Preferably, the linear or branched, volatile siloxanes are relatively volatile materials, having, for example, a boiling of below about 300° C. point at a pressure of 760 millimeters of mercury ("mm Hg").

In a preferred embodiment, the linear or branched, volatile siloxane comprises one or more compounds of the structural formula (I):

$$M_{2+y+2z}D_xT_yQ_z \quad (I)$$

wherein:

M is $R^1{}_3SiO_{1/2}$;

D is $R^2R^3SiO_{2/2}$;

T is $R^4SiO_{3/2}$;

and Q is $SiO_{4/2}$ $R^1$, $R^2$, $R^3$ and $R^4$ are each independently a monovalent hydrocarbon radical; and x and y are each integers, wherein $0 \leqq x \leqq 10$ and $0 \leqq y \leqq 10$ and $0 \leqq z \leqq 10$.

Suitable monovalent hydrocarbon groups include acyclic hydrocarbon radicals, monovalent alicyclic hydrocarbon radicals, monovalent and aromatic or fluoro containing hydrocarbon radicals. Preferred monovalent hydrocarbon radicals are monovalent alkyl radicals, monovalent aryl radicals and monovalent aralkyl radicals.

As used herein, the term "$(C_1-C_6)$alkyl" means a linear or branched alkyl group containing from 1 to 6 carbons per group, such as, for example, methyl, ethyl, propyl, isopropyl, n-butyl, iso-butyl, sec-butyl, tert-butyl, pentyl, hexyl, preferably methyl.

As used herein, the term "aryl" means a monovalent unsaturated hydrocarbon ring system containing one or more aromatic or fluoro containing rings per group, which may optionally be substituted on the one or more aromatic or fluoro containing rings, preferably with one or more $(C_1-C_6)$ alkyl groups and which, in the case of two or more rings, may be fused rings, including, for example, phenyl, 2,4,6-trimethylphenyl, 2-isopropylmethylphenyl, 1-pentalenyl, naphthyl, anthryl, preferably phenyl.

As used herein, the term "aralkyl" means an aryl derivative of an alkyl group, preferably a $(C_2-C_6)$alkyl group, wherein the alkyl portion of the aryl derivative may, optionally, be interrupted by an oxygen atom, such as, for example, phenylethyl, phenylpropyl, 2-(1-naphthyl)ethyl, preferably phenylpropyl, phenyoxypropyl, biphenyloxypropyl.

In a preferred embodiment, the monovalent hydrocarbon radical is a monovalent $(C_1-C_6)$alkyl radical, most preferably, methyl.

In a preferred embodiment, the linear or branched, volatile siloxane comprises one or more of, hexamethyldisiloxane, octamethyltrisiloxane, decamethyltetrasiloxane, dodecamethylpentasiloxane, tetradecamethylhexasiloxane or hexadecamethylheptasiloxane or methyltris(trimethylsiloxy)silane. In a more highly preferred embodiment, the linear or branched, volatile siloxane of the present invention comprises octamethyltrisiloxane, decamethyltetrasiloxane, or dodecamethylpentasiloxane or methyltris(trimethylsiloxy)silane. In a highly preferred embodiment, the siloxane component of the composition of the present invention consists essentially of decamethyltetrasiloxane.

Suitable linear or branched volatile siloxanes are made by known methods, such as, for example, hydrolysis and condensation of one or more of tetrachlorosilane, methyltrichlorosilane, dimethyldichlorosilane, trimethylchlorosilane, or by isolation of the desired fraction of an equilibrate mixture of hexamethyldisiloxane and octamethylcyclotetrasiloxane or the like and are commercially available.

Compounds suitable as the cyclic siloxane component of the present invention are those containing a polysiloxane ring structure that includes from 2 to 20 silicon atoms in the ring. Preferably, the linear, volatile siloxanes and cyclic siloxanes are relatively volatile materials, having, for example, a boiling point of below about 300° C. at a pressure of 760 millimeters of mercury ("mm Hg").

In a preferred embodiment, the cyclic siloxane component comprises one or more compounds of the structural formula (II):

(II)

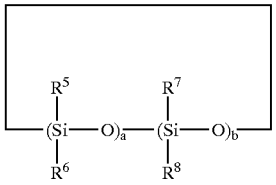

wherein:

$R^5$, $R^6$, $R^7$ and $R^8$ are each independently a monovalent hydrocarbon group; and a and b are each integers wherein $0 \leqq a \leqq 10$ and $0 \leqq b \leqq 10$, provided that $3 \leqq (a+b) \leqq 10$.

In a preferred embodiment, the cyclic siloxane comprises one or more of, octamethylcyclotetrasiloxane, decamethylcyclopentasiloxane, dodecamethylcyclohexasiloxane, tetradecamethylcycloheptasiloxane. In a more highly preferred embodiment, the cyclic siloxane of the present invention comprises octamethylcyclotetrasiloxane or decamethylcyclopentasiloxane. In a highly preferred embodiment, the cyclic siloxane component of the composition of the present invention consists essentially of decamethylcyclopentasiloxane.

Suitable cyclic siloxanes are made by known methods, such as, for example, hydrolysis and condensation of dimethyldichlorosilane and are commercially available.

The organic surfactant of the present invention comprises one or more surfactants selected from nonionic, cationic, anionic and amphoteric surfactants. In another embodiment, the organic surfactant comprises a mixture of two or more surfactants of the same or different classes, as long as they are compatible, such as, for example, a mixture of two or more nonionic, cationic, anionic or amphoteric surfactants, a mixture of nonionic and cationic surfactants, a mixture of nonionic and anionic surfactants, a mixture of nonionic and amphoteric surfactants, a mixture of cationic and anionic surfactants, a mixture of cationic and amphoteric surfactants, a mixture of anionic and amphoteric surfactants, a mixture of nonionic, cationic and anionic surfactants, a mixture of nonionic, anionic and amphoteric surfactants, a mixture of cationic anionic and amphoteric surfactants, or a mixture of nonionic, cationic, anionic and amphoteric surfactants.

Compounds suitable for use as the nonionic surfactant of the present invention are those that carry no discrete charge when dissolved in aqueous media. Nonionic surfactants are generally known in the art and include, for example, alkanol amides (such as, for example, coco, lauric, oleic and stearic monoethanolamides, diethanolamides and monoisopropanolamides), amine oxides (such as, for example, polyoxyethylene ethanolamides and polyoxyethylene propanolamides), polyalkylene oxide block copolymers (such as, for example, poly(oxyethylene-co-oxypropylene)), ethoxylated alcohols, (such as, for example, isostearyl polyoxyethylene alcohol, lauryl, cetyl, stearyl, oleyl, tridecyl, trimethylnonyl, isodecyl, tridecyl), ethoxylated alkylphenols (such as, for example, nonylphenol), ethoxylated amines and ethoxylated amides, ethoxylated fatty acids, ethoxylated fatty esters and ethoxylated fatty oils (such as, for example, mono- and diesters of acids such as lauric, isostearic, pelargonic, oleic, coco, stearic, and ricinoleic, and oils such as castor oil and tall oil), fatty esters, fluorocarbon containing materials, glycerol esters (such as, for example, glycerol monostearate, glycerol monolaurate, glycerol dilaurate, glycerol monoricinoleate, and glycerol oleate), glycol esters (such as, for example, propylene glycol monostearate, ethylene glycol monostearate, ethylene glycol distearate, diethylene glycol monolaurate, diethylene glycol monolaurate, diethylene glycol monooleate, and diethylene glycol stearate), lanolin-based surfactants, monoglycerides, phosphate esters, polysaccharide ethers, propoxylated fatty acids, propoxylated alcohols, and propoxylated alkylphenols, protein-based organic surfactants, sorbitan-based surfactants (such as, for example, sorbitan oleate, sorbitan monolaurate, and sorbitan palmitate), sucrose esters and glucose esters, and thio- and mercapto-based surfactants.

In a preferred embodiment, one component of the present invention comprises one or more nonionic surfactants according to one or more of the structural formulas III and IV:

$$R^9—O—(CH_2—CH_2—O)_n—R^{10} \quad (III)$$

$$R^9—O—(CH_2—C(CH_3)H—O)_n—R^{10} \quad (IV)$$

wherein:

$R^9$ is a monovalent hydrocarbon group of 1–30 carbons that may be linear, cyclic, branched, unsaturated, aromatic or fluoro containing, $R^{10}$ is hydrogen or a monovalent hydrocarbon group of 1 to 30 carbons that may be linear, cyclic, branched, unsaturated, aromatic or fluoro containing, and n is from about 1 to about 100, more preferably from about 1 to about 40. In a highly preferred embodiment, $R^9$ contains from 2 to about 24 carbons, even more preferably from 8 to 24 carbons, $R^{10}$ is H and n is from about 2 to about 20.

In another preferred embodiment, one component of the present invention comprises one or more nonionic surfactants that may be a sugar-based surfactant according to one or more of the structural formulas V and VI:

(V)

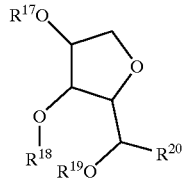

(VI)

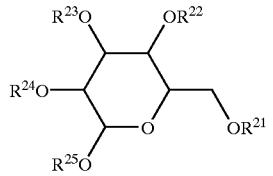

wherein:

each $R^{17}$, $R^{18}$, $R^{19}$, $R^{20}$, $R^{21}$, $R^{22}$, $R^{23}$, $R^{24}$ and $R^{25}$ is independently H or a monovalent hydrocarbon group of 1 to 30 carbons that may be linear, cyclic, branched, an oxygenated alkane or other chalcogen containing group. Chalcogens are herein specifically defined as oxygen, sulfur, selenium, tellurium and polonium. These surfactants may also be the open-chain analogs. In a preferred embodiment, $R^{17}$, $R^{18}$, $R^{19}$, $R^{20}$, $R^{21}$, $R^{22}$, $R^{23}$, $R^{24}$ and $R^{25}$ are each H or a hydrocarbon group of 1 to 24 carbons, preferably a polyether or ester, even more preferably, one of $R^{17}$ and $R^{20}$ is a hydrocarbon of from 8 to 24 carbons while the other is H or a hydrocarbon of from 1 to 4 carbons, such as —$CH_2OH$ or —$CH_2CH_3$, and one of $R^{21}$ and $R^{25}$ is H or a hydrocarbon of from 8 to 24 carbons while the other is a hydrocarbon of from 1 to 4 carbons, such as —$CH_2OH$ or —$CH_2CH_3$. In another preferred embodiment, the surfactant or surfactants are chosen from sucrose esters, glucose esters, monoglycerides, polysaccharide ethers and sorbitan-based surfactants.

In another preferred embodiment, one component of the present invention comprises one or more nonionic surfactants that may be an amine-based or phosphate ester-based surfactant according to one or more of the structural formulas VII and VIII:

(VII)

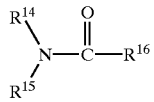

(VIII)

wherein:

each $R^{11}$, $R^{12}$, $R^{13}$, $R^{14}$, $R^{15}$, and $R^{16}$ is independently H or a monovalent hydrocarbon group of 1 to 30 carbons that may be linear, cyclic, branched, unsaturated, aromatic, fluoro containing, an oxygenated alkane or other chalcogen containing group. In a preferred embodiment, two of $R^{11}$, $R^{12}$ and $R^{13}$, are H or hydrocarbon groups of 1 to 4 carbons, and one is a hydrocarbon group of from 8 to 24 carbons, and $R^{14}$ and $R^{15}$ are either H or hydrocarbon groups of from 1 to 4 carbons while $R^{16}$ is a hydrocarbon group of from 8 to 24 carbons, or $R^{14}$ and $R^{15}$ are hydrocarbon groups of from 8 to 24 carbons while $R^{16}$ is a hydrocarbon group of from 1 to 4 carbons. In a most preferred embodiment, the surfactant or surfactants are chosen from alkanol amides, amine oxides, ethoxylated amines, ethoxylated amides and phosphate esters.

Compounds suitable for use as the anionic surfactant of the present invention are those having polar, solubilizing groups such as carboxylate, sulfonate, sulfate and phosphate. Anionic surfactants are generally known in the art and include, for example, alkyl aryl sulfonates (such as, for example, alkylbenzenesulfonates), alkyl aryl sulfonic acids (such as, for example, sodium and ammonium salts of toluene-, xylene- and isopropylbenzenesulfonic acids), sulfonated amines and sulfonated amides (such as, for example, amidosulfonates), carboxylated alcohols and carboxylated alkylphenol ethoxylates, diphenyl sulfonates, fatty esters, isethionates, lignin-based surfactants, olefin sulfonates (such as, for example, $RCH{=}CHSO_3Na$, where R is $C_{10}$–$C_{16}$), phosphorous-based surfactants, protein based surfactants, sarcosine-based surfactants (such as, for example, N-acylsarcosinates such as sodium N-lauroylsarcosinate), sulfates and sulfonates of oils and/or fatty acids, sulfates and sulfonates of ethoxylated alkylphenols, sulfates of alcohols, sulfates of ethoxylated alcohols, sulfates of fatty esters, sulfates of aromatic or fluoro containing compounds, sulfosuccinnamates, sulfosuccinates (such as, for example, diamyl-, dioctyl- and diisobutylsulfosuccinates), taurates, and sulfonic acids.

In a preferred embodiment, one component of the present invention comprises one or more anionic surfactants that may be a sulfosuccinate, sulfate, sulfonate, carboxylate, or phosphorous containing surfactant according to one or more of the structural formulas IX to XIII:

(IX)

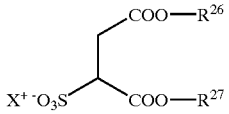

(X)

$(R^{28}—OSO_3^-)_q X^+$ (XI)

$(R^{28}—SO_3^-)_q X^+$ (XII)

$(R^{29}—CO_2^-)_q X^+$ (XIII)

$(R^{30}—OPO_3^-)_q X^+$ wherein:

each $R^{26}$, $R^{27}$, $R^{28}$, $R^{29}$ and $R^{30}$ is independently a monovalent hydrocarbon group of 1 to 30 carbons that may be linear, cyclic, branched, unsaturated, aromatic, fluoro containing, an oxygenated alkane or other chalcogen containing radical, and X is H or an alkali metal, alkaline earth element or a chalcogen containing counterion or other suitable cation that does not unduly interfere with the functioning of the molecule as a surfactant where the subscript q is the valence or oxidation state of the cation X. In a preferred embodiment, $R^{26}$ and $R^{27}$ are linear hydrocarbon groups of from 4 to 20 carbons, more preferably 6 to 13 carbons, $R^{28}$ is a hydrocarbon group of from 6 to 20 carbons, more preferably from 8 to 16 carbons, and $R^{29}$ is a hydrocarbon group of from 8 to 26 carbons, more preferably from 10 to 20 carbons, and $R^{30}$ is a hydrocarbon of from 8 to 30 carbons.

Compounds suitable for use as the cationic surfactant of the present invention are those having a positive charge when dissolved in aqueous media, which resides on an amino or quaternary nitrogen. Cationic surfactants are generally known in the art and include, for example, amine acetates, amines (such as, for example, oxygen-free amines such as monoalkylamines, dialkylamines and N-alkyltrimethylene diamines, and oxygen-containing amines such as amine oxides, ethoxylated alkylamines, 1-(2-hydroxyethyl)-2-imidazolines, and alkoxylates of ethylenediamine), and quaternary ammonium salts (such as, for example, dialkyldimethylammonium salts, alkylbenzyldimethylammonium chlorides, alkyltrimethylammonium salts and alkylpyridium halides), and quaternary ammonium esters (such as, for example, diethyl ester dimethyl ammonium chloride).

In a preferred embodiment, one component of the present invention comprises one or more cationic surfactants that may be a quaternary amine-based surfactant according to the structural formula XIV:

$$(R^{31}R^{32}R^{33}R^{34}N^{+})_pJ^{-} \quad \text{(XIV)}$$

wherein:

each $R^{31}$, $R^{32}$, $R^{33}$, and $R^{34}$ is independently H or a monovalent hydrocarbon group of 1 to 30 carbons that may be linear, cyclic, branched, unsaturated, aromatic, fluoro containing, an oxygenated alkane or other chalcogen containing group, and J is a suitable anion having an oxidation state or valence p that does not unduly interfere with the functioning of the molecule as a surfactant. In a preferred embodiment, $R^{31}$ and $R^{32}$ are hydrocarbon groups of from 1 to 4 carbons, more preferably, methyl, and $R^{33}$ and $R^{34}$ are hydrocarbon groups of from 6 to 30 carbons, more preferably from 8 to 24 carbons.

Compounds suitable for use as the amphoteric surfactant of the present invention are those containing both an acidic and basic hydrophilic group. Amphoteric surfactants are compatible with anionic and cationic surfactants. Amphoteric surfactants are generally known in the art and include, for example, betaine derivatives such as alkylbetaines and amidopropylbetaines, block copolymers, imidazolines and lecithins.

In a preferred embodiment, one component of the present invention comprises one or more amphoteric surfactants according to the structural formula XV:

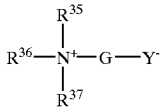

(XIV)

wherein:

each $R^{35}$, $R^{36}$ and $R^{37}$ is independently H or a monovalent hydrocarbon group of 1 to 30 carbons that may be linear, cyclic, branched, unsaturated, aromatic, fluoro containing, an oxygenated alkane or other chalcogen containing group, G is a divalent spacer group, and Y is a carboxylate, sulfonate, sulfate, phosphonate or other similar group. In a preferred embodiment, $R^{35}$, is a hydrocarbon of from 1 to 4 carbons, and $R^{36}$ and $R^{37}$ are hydrocarbons of from 6 to 24 carbons.

Surfactants are known in the art and are commercially available under many trade names from many sources, such as for example, Akzo Chemical Co., Calgene Chemical Inc., Emkay Chemical Co, Hercules, Inc., ICI Americas Inc., Lonza, Inc., Rhone Poulenc, Inc., Union Carbide Corp. and Witco Corp.

In a preferred embodiment, the dry cleaning composition of the present invention further comprises a minor amount, preferably, less than 50 pbw per 100 pbw of the composition, more preferably, less than 10 pbw per 100 pbw of the composition, of one or more non-siloxane fluids. Suitable non-siloxane fluids include aqueous fluids, such as, for example, water, and organic fluids, for example, hydrocarbon fluids and halogenated hydrocarbon fluids.

An article, such as for example, a textile or leather article, typically, a garment, is dry cleaned by contacting the article with the composition of the present invention. In a preferred embodiment, the articles to be cleaned include textiles made from natural fibers, such as for example, cotton, wool, linen and hemp, from synthetic fibers, such as, for example, polyester fibers, polyamide fibers, polypropylene fibers and elastomeric fibers, from blends of natural and synthetic fibers, from natural or synthetic leather or natural or synthetic fur.

The article and dry cleaning composition are then separated, by, for example, one or more of draining and centrifugation. In a preferred embodiment, separation of the article and dry cleaning composition is followed by the application of heat, preferably, heating to a temperature of from 15° C. to 120° C., preferably from 20° C. to 100° C., or reduced pressure, preferably, a pressure of from 1 mm Hg to 750 mm Hg, or by application of both heat and reduced pressure, to the article.

Testing for water soluble stain removal was accomplished using fabric swatches supplied by the International Fabricare Institute ("IFI") (Silver Spring, Md.) that contained a water soluble dye. The color change of a swatch of this material was measured by a Minolta CR-300® Colorimeter using the Hunter Color Number difference calculations. The larger the change in Hunter Color Number (ΔE), the greater the dye removal and the more efficient the cleaning.

The following examples are to illustrate the invention and are not to be construed as limiting the claims.

EXAMPLES

Testing procedure: Circular swatches (from IFI) containing a water soluble dye were measured by the colorimeter, and the initial color values for L, a and b (as defined by the Hunter Color Numbers) were recorded. The fabric swatches were then placed in vials containing the cleaning composition of the present invention, and the vial was shaken for 10 minutes at ambient temperature. The fabric swatch was removed and allowed to drip dry for 2 to 5 seconds, then placed on absorbent toweling and allowed to air dry for 16 to 24 hours. A second reading of each fabric swatch was taken and the color difference (ΔE) was determined using the following formula:

$$\Delta E=[(L_1-L_2)^2+(a_1-a_2)^2=(b_1-b_2)^2]^{1/2}$$

This color difference represents the relative amount of cleaning, with the higher ΔE indicative of better cleaning performance.

Example 1

Nonionic Surfactants [Ethoxylated Alcohols]

A cleaning composition according to the present invention containing a cyclic siloxane ($D_5$) and one or more nonionic surfactants was made. Fabric swatches were cleaned using the above procedure, and the color difference was measured to determine the effectiveness of the cleaning composition. A solution of cyclic siloxane ($D_5$) without a surfactant was used as a control.

Nonionic surfactants used in the example are those represented by formula III above, where $R^9$ and n are as described in Table 1, and $R^{10}$ is H.

TABLE 1

Ethoxylated Alcohols

| Exp. No. | $R^9$ | n | pbw | ΔE |
|---|---|---|---|---|
| 1 | $C_4$ | 1 | 1 | 1.9 |
| 2 | $C_4$ | 1 | 5 | 2.7 |
| 3 | $C_4$ | 2 | 1 | 3.2 |
| 4 | $C_4$ | 2 | 5 | 3.2 |
| 5 | $C_{12-15}$ | 3 | 1 | 38.8 |
| 6 | $C_{12-15}$ | 3 | 5 | 41.1 |
| 7 | $C_{12-13}$ | 9 | 1 | 37.8 |
| 8 | $C_{12-13}$ | 9 | 5 | 38.7 |
| 9 | $C_{12-13}$ | 6.5 | 1 | 39.1 |
| 10 | $C_{12-13}$ | 6.5 | 5 | 38.7 |
| 11 | $C_{14-15}$ | 7 | 1 | 2.0 [18.7] |
| 12 | $C_{14-15}$ | 7 | 5 | 39.0 [33.7] |
| 13 | $C_{12-13}/C_4$ | 6.5/1 | 5 (50/50) | 41.5 |
| 14 | $C_{12-13}/C_4$ | 9/1 | 5 (50/50) | 42.9 |
| 15 | $C_{14-15}/C_4$ | 3/1 | 5 (50/50) | 13.8 |
| 16 | $C_{14-15}/C_4$ | 7/1 | 5 (50/50) | 41.1 |
| 17 | $C_{12}$ | 4 | 1 | 35.8 |
| 18 | $C_{12}$ | 4 | 5 | 40.7 |
| 19 | $C_{12}$ | 23 | 1 | 0.9 |
| 20 | $C_{12}$ | 23 | 5 | 1.3 |
| 21 | $C_{16}$ | 2 | 1 | 4.6 |
| 22 | $C_{16}$ | 2 | 5 | 2.0 |
| 23 | $C_{18}$ | 2 | 1 | 2.6 |
| 24 | $C_{18}$ | 2 | 5 | 19.0 |
| 25 | $C_{18}$ | 10 | 1 | 2.4 |
| 26 | $C_{18}$ | 10 | 5 | 23.4 |
| 27 | $C_{18}$ | 20 | 1 | 4.0 |
| 28 | $C_{18}$ | 20 | 5 | 22.8 |
| 29 | $C_{12}/C_4$ | 4/1 | 5 (50/50) | 41.1 |
| 39 | $C_{12}/C_4$ | 23/1 | 5 (50/50) | 1.6 |
| 31 | $C_{16}/C_4$ | 2/1 | 5 (50/50) | 3.7 |
| 32 | $C_{18}/C_4$ | 2/1 | 5 (50/50) | 11.4 |
| 33 | $C_{18}/C_4$ | 10/1 | 5 (50/50) | 21.1 |
| 34 | $C_{18}/C_4$ | 20/1 | 5 (50/50) | 34.4 |
| Control 1 | — | — | 0 | 1.9 |

Table 1 shows that nonionic surfactants enhance the cleaning and dye removal of the base cyclic siloxane ($D_5$) solvent.

Example 2

Anionic Surfactants

A cleaning composition according to the present invention containing a cyclic siloxane ($D_5$) and one or more anionic surfactants was made. Fabric swatches were cleaned using the above procedure, and the color difference was measured to determine the effectiveness of the cleaning composition. A solution of cyclic siloxane ($D_5$) without a surfactant was used as a control.

TABLE 2

Sulfosuccinates

| Exp. | Designation* | mixture | pbw | ΔE |
|---|---|---|---|---|
| 35 | Aerosol TR | — | 1 | 2.8 |
| 36 | Aerosol TR | — | 5 | 6.5 |
| 37 | Aerosol OT | — | 1 | 1.6 |
| 38 | Aerosol OT | — | 5 | 2.3 |
| 39 | Aerosol GPG | — | 1 | 3.0 |
| 40 | Aerosol GPG | — | 5 | 3.0 |
| 41 | Aerosol TR/OT | 50/50 | 1 | 1.5 |
| 42 | Aerosol TR/OT | 50/50 | 5 | 2.5 |

TABLE 2-continued

Sulfosuccinates

| Exp. | Designation* | mixture | pbw | ΔE |
|---|---|---|---|---|
| 43 | Aerosol TR/GPG | 50/50 | 1 | 6.9 |
| 44 | Aerosol TR/GPG | 50/50 | 5 | 16.9 |
| 45 | Aerosol OT/GPG | 50/50 | 1 | 4.6 |
| 46 | Aerosol OT/GPG | 50/50 | 5 | 6.7 |
| Control 2 | — | — | 0 | 1.9 |

*Commercially available from Cytek Industries

Table 2 shows that the anionic sulfosuccinate surfactants enhanced the water soluble dye removal of the base cyclic siloxane ($D_5$) solvent. (Surfactant TR is a solution in 20% ethanol and 10% water; GPG is a solution in 8% ethanol and 22% water.)

Example 3

Cationic and Anionic Surfactants

A cleaning composition according to the present invention containing a cyclic siloxane ($D_5$) and one or more anionic and cationic surfactants was made. Fabric swatches were cleaned using the above procedure, and the color difference was measured to determine the effectiveness of the cleaning composition. A solution of cyclic siloxane ($D_5$) without a surfactant was used as a control.

TABLE 3

Ionic Surfactants (Cationic and Anionic)

| Exp | Type | R | pbw | ΔE |
|---|---|---|---|---|
| 47 | $R—SO_4^-Na^+$ | $C_{14-16}$ alkene | 5 | 11.2 |
| 48 | $R_2Me_2N^+Cl^-$ | $C_{12}$ | 1 | 41.5 |
| 49 | $R_2Me_2N^+Cl^-$ | $C_{12}$ | 5 | 41.2 |
| 50 | DDBSA | — | 1 | 51.5 |
| 51 | DDBSA | — | 5 | 50.4 |
| 52 | $R—PhO—(EO)_3^-OSO_3^-Na^+$ | $C_{12}$ | 1 | 6.2 |
| 53 | $R—PhO—(FO)_3^-OSO_3^-Na^+$ | $C_{12}$ | 5 | 5.3 |
| 54 | $R—SO_4^-Na^+$ | $C_{12}$ | 1 | 2.7 |
| 55 | $R—SO_4^-Na^+$ | $C_{12}$ | 5 | 3.4 |
| Control 3 | — | — | 0 | 1.9 |

Table 3 shows that the ionic surfactants enhanced the water soluble dye removal of the base cyclic siloxane ($D_5$) solvent. ($R_2Me_2N^+Cl^-$came as a solution in water.)

Example 4

Nonionic Surfactants with Water

A cleaning composition according to the present invention containing a cyclic siloxane ($D_5$), water and a nonionic surfactant was made. Fabric swatches were cleaned using the above procedure, and the color difference was measured to determine the effectiveness of the cleaning composition. A solution of cyclic siloxane ($D_5$) without a surfactant was used as a control. Nonionic surfactants used in the example are those represented by formula III above, where $R^9$ and n are as described in Table 4, and $R^{10}$ is H.

TABLE 4

Nonionic Surfactants

| Exp. No. | $R^9$ | n | pbw solvent | pbw surfactant | pbw water | ΔE |
|---|---|---|---|---|---|---|
| 1 | $C_{12-13}$ | 6.5 | 95 | 4 | 1 | 39.5 |
| 2 | $C_{12-13}$ | 6.5 | 95 | 1 | 4 | 33.1 |
| 3 | $C_{12-13}$ | 6.5 | 98 | 1 | 1 | 13.8 |
| 4 | $C_{12-13}$ | 9 | 95 | 4 | 1 | 34.9 |
| 5 | $C_{12-13}$ | 9 | 95 | 1 | 4 | 38.3 |
| 6 | $C_{12-13}$ | 9 | 98 | 1 | 1 | 25.5 |
| 7 | $C_{12-15}$ | 3 | 95 | 4 | 1 | 7.7 |
| 8 | $C_{12-15}$ | 3 | 95 | 1 | 4 | 38.3 |
| 9 | $C_{12-15}$ | 3 | 98 | 1 | 1 | 38.9 |
| 10 | $C_{14-15}$ | 7 | 95 | 4 | 1 | 34.5 |
| 11 | $C_{14-15}$ | 7 | 95 | 1 | 4 | 36.4 |
| 12 | $C_{14-15}$ | 7 | 98 | 1 | 1 | 7.9 |
| 13 | $C_{12}$ | 4 | 95 | 4 | 1 | 17.9 |
| 14 | $C_{12}$ | 4 | 95 | 1 | 4 | 32.3 |
| 15 | $C_{12}$ | 4 | 98 | 1 | 1 | 37.4 |
| 16 | $C_{12}$ | 23 | 95 | 4 | 1 | 24.5 |
| 17 | $C_{12}$ | 23 | 95 | 1 | 4 | 34.2 |
| 18 | $C_{12}$ | 23 | 98 | 1 | 1 | 1.5 |
| 19 | $C_{16}$ | 20 | 95 | 4 | 1 | 25.7 |
| 20 | $C_{16}$ | 20 | 95 | 1 | 4 | 11.8 |
| 21 | $C_{16}$ | 20 | 98 | 1 | 1 | 17.4 |
| 22 | $C_{18}$ | 2 | 95 | 4 | 1 | 8.5 |
| 23 | $C_{18}$ | 2 | 95 | 1 | 4 | 7.9 |
| 24 | $C_{18}$ | 2 | 98 | 1 | 1 | 5.5 |
| 25 | $C_{18}$ | 10 | 95 | 4 | 1 | 16.8 |
| 26 | $C_{18}$ | 10 | 95 | 1 | 4 | 6.2 |
| 27 | $C_{18}$ | 10 | 98 | 1 | 1 | 3.7 |
| 28 | $C_{18}$ | 20 | 95 | 4 | 1 | 13.6 |
| 29 | $C_{18}$ | 20 | 95 | 1 | 4 | 28.4 |
| 30 | $C_{18}$ | 20 | 98 | 1 | 1 | 5.3 |
| 31 | $C_4$ | 1 | 95 | 4 | 1 | 6.2 |
| 32 | $C_4$ | 1 | 95 | 1 | 4 | 11.7 |
| 33 | $C_4$ | 1 | 98 | 1 | 1 | 1.0 |
| 34 | $C_4$ | 2 | 95 | 4 | 1 | 33.9 |
| 35 | $C_4$ | 2 | 95 | 1 | 4 | 34.1 |
| 36 | $C_4$ | 2 | 98 | 1 | 1 | 38.7 |
| 37 | $C_{11-14}$ | 12 | 95 | 4 | 1 | 24.1 |
| 38 | $C_{11-14}$ | 12 | 95 | 1 | 4 | 33.1 |
| 39 | $C_{11-14}$ | 12 | 98 | 1 | 1 | 10.2 |
| Control 4 | — | — | 99 | 0 | 1 | 2.2 |
| Control 5 | — | — | 96 | 0 | 4 | 9.5 |

TABLE 4A

Nonionic Surfactants (Commercially Available)

| Exp. | Surfactant Trade Name | n | pbw solvent | pbw surfactant | pbw water | ΔE |
|---|---|---|---|---|---|---|
| 40 | Triton X-405 | 40 | 95 | 4 | 1 | 37.7 |
| 41 | Triton X-405 | 40 | 95 | 1 | 4 | 25.5 |
| 42 | Triton X-405 | 40 | 98 | 1 | 1 | 15.9 |
| 43 | Igepal CA-520 | 5 | 95 | 4 | 1 | 4.4 |
| 44 | Igepal CA-520 | 5 | 95 | 1 | 4 | 10.0 |
| 45 | Igepal CA-520 | 5 | 98 | 1 | 1 | 2.3 |
| 46 | Igepal CO-850 | 20 | 95 | 4 | 1 | 4.0 |
| 47 | Igepal CO-850 | 20 | 95 | 1 | 4 | 2.6 |
| 48 | Igepal CO-850 | 20 | 98 | 1 | 1 | 16.2 |
| 49 | Span-80 | — | 95 | 4 | 1 | 3.7 |
| 50 | Span-80 | — | 95 | 1 | 4 | 2.4 |
| 51 | Span-80 | — | 98 | 1 | 1 | 5.2 |
| Control 1 | — | — | 99 | 0 | 1 | 2.2 |
| Control 2 | — | — | 96 | 0 | 4 | 9.5 |

Tables 4 and 4A show that nonionic surfactants in the presence of water enhance the cleaning and dye removal of the base cyclic siloxane ($D_5$) solvent.

Example 5

Ionic Surfactants

A cleaning composition according to the present invention containing a cyclic siloxane ($D_5$), water and an ionic surfactant was made. Fabric swatches were cleaned using the above procedure, and the color difference was measured to determine the effectiveness of the cleaning composition. A solution of cyclic siloxane ($D_5$) and water without a surfactant was used as a control.

TABLE 5

Ionic Surfactants

| Exp | Surfactant Trade Name | pbw solvent | pbw surfactant | pbw Water | ΔE |
|---|---|---|---|---|---|
| 52 | Aerosol OT | 95 | 4 | 1 | 6.9 |
| 53 | Aerosol OT | 95 | 1 | 4 | 20.3 |
| 54 | Aerosol OT | 98 | 1 | 1 | 7.5 |
| 55 | Triton X-200 | 95 | 4 | 1 | 4.0 |
| 56 | Triton X-200 | 95 | 1 | 4 | 36.0 |
| 57 | Triton X-200 | 98 | 1 | 1 | 3.3 |
| 58 | Vari-Soft 300 | 95 | 4 | 1 | 40.3 |
| 59 | Vari-Soft 300 | 95 | 1 | 4 | 38.4 |
| 60 | Vari-Soft 300 | 98 | 1 | 1 | 35.9 |
| 61 | Bio-Soft D-62 | 95 | 4 | 1 | 2.9 |
| 62 | Bio-Soft D-62 | 95 | 1 | 4 | 28.4 |
| 63 | Bio-Soft D-62 | 98 | 1 | 1 | 14.3 |
| 64 | Ethoquad C/25 | 95 | 4 | 1 | 35.2 |
| 65 | Ethoquad C/25 | 95 | 1 | 4 | 34.3 |
| 66 | Ethoquad C/25 | 98 | 1 | 1 | 26.3 |
| 67 | Span-80 | 95 | 4 | 1 | 3.7 |
| 68 | Span-80 | 95 | 1 | 4 | 2.4 |
| 69 | Span-80 | 98 | 1 | 1 | 5.2 |
| 70 | Glucopon 225* | 95 | 1 | 4 | 4.7 |
| 71 | Glucopon 225 | 95 | 4 | 1 | 31.2 |
| 72 | Glucopon 225 | 98 | 1 | 1 | 5.8 |
| 73 | Glucopon 225 | 99 | 1 | — | 10.8 |
| 74 | Glucopon 425** | 95 | 1 | 4 | 32.5 |
| 75 | Glucopon 425 | 95 | 4 | 1 | 36.2 |
| 76 | Glucopon 425 | 98 | 1 | 1 | 19.0 |
| 77 | Glucopon 425 | 99 | 1 | — | 3.9 |
| 78 | Glucopon 600** | 95 | 1 | 4 | 4.3 |
| 79 | Glucopon 600 | 95 | 4 | 1 | 27.9 |
| 80 | Glucopon 600 | 98 | 1 | 1 | 4.7 |
| 81 | Glucopon 600 | 99 | 1 | — | 9.3 |
| 82 | Alkamide S-280 | 95 | 5 | — | 8.4 |
| 83 | Alkamide S-280 | 99 | 1 | — | 1.7 |
| 84 | Alkamide S-280 | 98 | 1 | 1 | 2.0 |
| 85 | Alkamide CME | 95 | 5 | — | 7.6 |
| 86 | Alkamide CME | 99 | 1 | — | 2.4 |
| 87 | Alkamide CME | 98 | 1 | 1 | 6.6 |
| Control 6 | — | 99 | 0 | 1 | 2.2 |
| Control 7 | — | 96 | 0 | 4 | 9.5 |

*30% water;

**50% water

Table 5 shows that the ionic surfactants in the presence of water enhanced the water soluble dye removal of the base cyclic siloxane ($D_5$) solvent.

TABLE 6

Ionic surfactants with and without water

| Exp | pbw solvent | Surfactant | pbw surfactant | pbw Water | ΔE |
|---|---|---|---|---|---|
| 88 | 14.25 | Cocoa/oleamidopropyl betaine (30% in water) | 0.75 | — | 14.39 |
| 89 | 14.85 | Cocoa/oleamidopropyl betaine (30% in water) | 0.15 | — | 16.76 |
| 90 | 14.7 | Cocoa/oleamidopropyl betaine (30% in water) | 0.15 | 0.15 | 32.02 |
| 91 | 14.25 | Cocomidopropyl betaine (29% in water) | 0.6 | — | 31.20 |
| 92 | 14.85 | Cocomidopropyl betaine (29% in water) | 0.15 | — | 7.11 |
| 93 | 14.7 | Cocomidopropyl betaine (29% in water) | 0.15 | 0.15 | 29.80 |
| 94 | 14.25 | Stearic acid monoethanolamide | 0.6 | — | 8.37 |
| 95 | 14.85 | Stearic acid monoethanolamide | 0.15 | — | 1.72 |
| 96 | 14.7 | Stearic acid monoethanolamide | 0.15 | 0.15 | 1.96 |
| 97 | 14.25 | Amphoteric surfactant (50% in water) | 0.6 | — | 33.76 |
| 98 | 14.85 | Amphoteric surfactant (50% in water) | 0.15 | — | 24.95 |
| 99 | 14.7 | Amphoteric surfactant (50% in water) | 0.15 | 0.15 | 32.09 |
| 100 | 14.25 | Coconut fatty acid monoethanolamide | 0.6 | — | 7.61 |
| 101 | 14.85 | Coconut fatty acid monoethanolamide | 0.15 | — | 2.40 |
| 102 | 14.7 | Coconut fatty acid monoethanolamide | 0.15 | 0.15 | 6.59 |
| 103 | 14.25 | 1,2-hexanediol | 0.6 | — | 3.86 |
| 104 | 14.85 | 1,2-hexanediol | 0.15 | — | 21.40 |
| 105 | 14.7 | 1,2-hexanediol | 0.15 | 0.15 | 14.85 |
| 106 | 14.85 | Di(ethyleneglycol)-2-ethylhexyl ether | 0.15 | — | 8.03 |
| 107 | 14.25 | Di(ethyleneglycol)-2-ethylhexyl ether | 0.75 | — | 10.40 |
| 108 | 14.25 | Di(ethyleneglycol)-2-ethylhexyl ether | 0.6 | 0.15 | 9.85 |
| 109 | 14.25 | Di(ethyleneglycol)-2-ethylhexyl ether | 0.15 | 0.6 | 13.97 |
| 110 | 14.7 | Di(ethyleneglycol)-2-ethylhexyl ether | 0.15 | 0.15 | 22.73 |
| 111 | 14.85 | Di(ethyleneglycol)hexyl ether | 0.15 | — | 8.89 |
| 112 | 14.25 | Di(ethyleneglycol)hexyl ether | 0.75 | — | 9.13 |
| 113 | 14.25 | Di(ethyleneglycol)hexyl ether | 0.6 | 0.15 | 33.40 |
| 114 | 14.25 | Di(ethyleneglycol)hexyl ether | 0.15 | 0.6 | 16.64 |
| 115 | 14.7 | Di(ethyleneglycol)hexyl ether | 0.15 | 0.15 | 24.02 |
| 116 | 14.85 | Didecyldimethylammonium bromide | 0.15 | — | 16.55 |
| 117 | 14.25 | Didecyldimethylammonium bromide | 0.75 | — | 15.44 |
| 118 | 14.25 | Didecyldimethylammonium bromide | 0.6 | 0.15 | 4.78 |
| 119 | 14.25 | Didecyldimethylammonium bromide | 0.15 | 0.6 | 10.36 |
| 120 | 14.7 | Didecyldimethylammonium bromide | 0.15 | 0.15 | 10.88 |
| 121 | 14.85 | Dihexadecyldimethylammonium bromide | 0.15 | — | 12.53 |
| 122 | 14.25 | Dihexadecyldimethylammonium bromide | 0.75 | — | 12.15 |
| 123 | 14.25 | Dihexadecyldimethylammonium bromide | 0.6 | 0.15 | 8.73 |
| 124 | 14.25 | Dihexadecyldimethylammonium bromide | 0.15 | 0.6 | 9.56 |
| 125 | 14.7 | Dihexadecyldimethylammonium bromide | 0.15 | 0.15 | 9.45 |
| 126 | 14.85 | Cetyltrimethylammonium bromide | 0.15 | — | 13.03 |
| 127 | 14.25 | Cetyltrimethylammonium bromide | 0.75 | — | 14.79 |
| 128 | 14.25 | Cetyltrimethylammonium bromide | 0.6 | 0.15 | 12.25 |
| 129 | 14.25 | Cetyltrimethylammonium bromide | 0.15 | 0.6 | 38.27 |
| 130 | 14.7 | Cetyltrimethylammonium bromide | 0.15 | 0.15 | 10.39 |
| 131 | 14.85 | 1,2-butanediol | 0.15 | — | 26.14 |
| 132 | 14.25 | 1,2-butanediol | 0.75 | — | 33.45 |
| 133 | 14.7 | 1,2-butanediol | 0.15 | 0.15 | 21.40 |
| 134 | 14.85 | 1,2-decanediol | 0.15 | — | 11.26 |
| 135 | 14.25 | 1,2-decanediol | 0.75 | — | 29.54 |
| 136 | 14.7 | 1,2-decanediol | 0.15 | 0.15 | 11.55 |
| 137 | 14.85 | 1,2-hexanediol | 0.15 | — | 10.01 |
| 138 | 14.25 | 1,2-hexanediol | 0.75 | — | 28.56 |
| 139 | 14.7 | 1,2-hexanediol | 0.15 | 0.15 | 32.51 |
| 140 | 14.85 | 1,6-hexanediol | 0.15 | — | 7.47 |
| 141 | 14.25 | 1,6-hexanediol | 0.75 | — | 5.16 |
| 142 | 14.7 | 1,6-hexanediol | 0.15 | 0.15 | 31.78 |
| 143 | 14.85 | 1,10-decanediol | 0.15 | — | 5.82 |
| 144 | 14.25 | 1,10-decanediol | 0.75 | — | 1.22 |
| 145 | 14.7 | 1,10-decanediol | 0.15 | 0.15 | 8.33 |

Table 7 shows the variations in R and x that were explored for these surfactants. Mixtures of materials within a class were also examined as seen in experiments 13–16 and 29–34. None of these surfactants were soluble in D5 in the ranges examined but some were only slightly hazy. As seen in Table 1, the surfactants with R=$C_{12-15}$ and x=3–9 repeat units gave the best cleaning.

TABLE 7

Ethoxylated Alcohols.

| Exp. | Surfactant | R | n | pbw | ΔE |
|---|---|---|---|---|---|
| 146 | 06383 | $C_4$ | 1 | 1 | 1.9 |
| 147 | | $C_4$ | 1 | 5 | 2.7 |
| 148 | 2-(2-n-butoxy ethoxy)ethanol | $C_4$ | 2 | 1 | 3.2 |
| 149 | 067012 | $C_4$ | 2 | 5 | 3.2 |
| 150 | Neodol 25-3 | $C_{12-15}$ | 3 | 1 | 38.8 |
| 151 | | $C_{12-15}$ | 3 | 5 | 41.9 |
| 152 | Neodol 23-9 | $C_{12-13}$ | 9 | 1 | 37.8 |
| 153 | | $C_{12-13}$ | 9 | 5 | 38.7 |
| 154 | Neodol 23-6.5 | $C_{12-13}$ | 6.5 | 1 | 39.1 |
| 155 | | $C_{12-13}$ | 6.5 | 5 | 38.6 |
| 156 | Neodol 45-7 | $C_{14-15}$ | 7 | 1 | 18.7 |
| 157 | | $C_{14-15}$ | 7 | 5 | 36.7 |
| 158 | | $C_{14-15}$ | 7 | 5 | 30.7 |
| 159 | | $C_{12-13}/C_4$ | 6.5/1 | 5 (50/50) | 41.5 |
| 160 | | $C_{12-13}/C_4$ | 9/1 | 5 (50/50) | 42.9 |
| 161 | | $C_{12-13}/C_4$ | 3/1 | 5 (50/50) | 13.8 |
| 162 | | $C_{12-13}/C_4$ | 7/1 | 5 (50/50) | 41.1 |
| 163 | BRIJ 30 | $C_{12}$ | 4 | 1 | 35.8 |
| 164 | 067220 | $C_{12}$ | 4 | 5 | 40.7 |
| 165 | BRIJ 35 | $C_{12}$ | 23 | 1 | 0.9 |
| 166 | 067219 | $C_{12}$ | 23 | 5 | 1.3 |
| 167 | BRIJ 58 | $C_{16}$ | 20 | 1 | 4.6 |
| 168 | | $C_{16}$ | 20 | 5 | 2.0 |
| 169 | BRIJ 72 | $C_{18}$ | 2 | 1 | 2.6 |
| 170 | 067263 | $C_{18}$ | 2 | 5 | 19.0 |
| 171 | BRIJ 76 | $C_{18}$ | 10 | 1 | 2.4 |
| 172 | 067262 | $C_{18}$ | 10 | 5 | 23.4 |
| 173 | BRIJ 78 | $C_{18}$ | 20 | 1 | 4.0 |
| 174 | | $C_{18}$ | 20 | 5 | 22.8 |
| 175 | | $C_{12}/C_4$ | 4/1 | 5 (50/50) | 41.1 |
| 176 | | $C_{12}/C_4$ | 23/1 | 5 (50/50) | 1.6 |
| 177 | | $C_{12}/C_4$ | 2/1 | 5 (50/50) | 3.7 |
| 178 | | $C_{12}/C_4$ | 2/1 | 5 (50/50) | 11.4 |
| 179 | | $C_{12}/C_4$ | 10/1 | 5 (50/50) | 21.1 |
| 180 | | $C_{12}/C_4$ | 20/1 | 5 (50/50) | 34.4 |
| Control 1 | | — | — | 0 | 1.9 |

When similar compositions of 1 and $D_5$ with water were examined, again, the best cleaning was seen with R=$C_{12-15}$ and x=3–9 repeat units (Table 2).

TABLE 2

Ethoxylated Alcohols with Water.

| Exp. No. | Surfactant | R | n | pbw solvent | pbw surfactant | pbw water | ΔE |
|---|---|---|---|---|---|---|---|
| 35 | Neodol 23-6.5 | $C_{12-13}$ | 6.5 | 95 | 4 | 1 | 39.5 |
| 36 | | $C_{12-13}$ | 6.5 | 95 | 1 | 4 | 33.1 |
| 37 | | $C_{12-13}$ | 6.5 | 98 | 1 | 1 | 13.8 |
| 38 | Neodol 23-9 | $C_{12-13}$ | 9 | 95 | 4 | 1 | 34.9 |
| 39 | | $C_{12-13}$ | 9 | 95 | 1 | 4 | 38.3 |
| 40 | | $C_{12-13}$ | 9 | 98 | 1 | 1 | 25.5 |
| 41 | Neodol 25-3 | $C_{12-15}$ | 3 | 95 | 4 | 1 | 7.7 |
| 42 | | $C_{12-15}$ | 3 | 95 | 1 | 4 | 38.3 |
| 43 | | $C_{12-15}$ | 3 | 98 | 1 | 1 | 38.9 |
| 44 | Neodol 45-7 | $C_{14-15}$ | 7 | 95 | 4 | 1 | 34.5 |
| 45 | | $C_{14-15}$ | 7 | 95 | 1 | 4 | 36.4 |
| 46 | | $C_{14-15}$ | 7 | 98 | 1 | 1 | 7.9 |
| 47 | BRIJ 30 | $C_{12}$ | 4 | 95 | 4 | 1 | 17.9 |
| 48 | | $C_{12}$ | 4 | 95 | 1 | 4 | 32.3 |

TABLE 2-continued

Ethoxylated Alcohols with Water.

| Exp. No. | Surfactant | R | n | pbw solvent | pbw surfactant | pbw water | ΔE |
|---|---|---|---|---|---|---|---|
| 49 | | $C_{12}$ | 4 | 98 | 1 | 1 | 37.4 |
| 50 | BRIJ 35 | $C_{12}$ | 23 | 95 | 4 | 1 | 24.5 |
| 51 | | $C_{12}$ | 23 | 95 | 1 | 4 | 34.2 |
| 52 | | $C_{12}$ | 23 | 98 | 1 | 1 | 1.5 |
| 53 | BRIJ 58 | $C_{12}$ | 20 | 95 | 4 | 1 | 25.7 |
| 54 | | $C_{16}$ | 20 | 95 | 1 | 4 | 11.8 |
| 55 | | $C_{16}$ | 20 | 98 | 1 | 1 | 17.4 |
| 56 | BRIJ 72 | $C_{18}$ | 2 | 95 | 4 | 1 | 8.5 |
| 57 | | $C_{18}$ | 2 | 95 | 1 | 4 | 7.9 |
| 58 | | $C_{18}$ | 2 | 98 | 1 | 1 | 5.5 |
| 59 | BRIJ 76 | $C_{18}$ | 10 | 95 | 4 | 1 | 16.8 |
| 60 | | $C_{18}$ | 10 | 95 | 1 | 4 | 6.2 |
| 61 | | $C_{18}$ | 10 | 98 | 1 | 1 | 3.7 |
| 62 | BRIJ 78 | $C_{18}$ | 20 | 95 | 4 | 1 | 13.6 |
| 63 | | $C_{18}$ | 20 | 95 | 1 | 4 | 28.4 |
| 64 | | $C_{18}$ | 20 | 98 | 1 | 1 | 5.3 |
| 65 | 06383 | $C_4$ | 1 | 95 | 4 | 1 | 6.2 |
| 66 | | $C_4$ | 1 | 95 | 1 | 4 | 11.7 |
| 67 | | $C_4$ | 1 | 98 | 1 | 1 | 1.0 |
| 68 | 067012 | $C_4$ | 2 | 95 | 4 | 1 | 33.9 |
| 69 | | $C_4$ | 2 | 95 | 1 | 4 | 34.1 |
| 70 | | $C_4$ | 2 | 98 | 1 | 1 | 38.7 |
| 71 | | $C_{11-14}$ | 12 | 95 | 4 | 1 | 24.1 |
| 72 | | $C_{11-14}$ | 12 | 95 | 1 | 4 | 33.1 |
| 73 | | $C_{11-14}$ | 12 | 98 | 1 | 1 | 10.2 |
| Control 2 | | — | — | 95 | 0 | 1 | 5.3 |
| Control 3 | | — | — | 99 | 0 | 4 | 2.9 |
| Control 4 | | — | — | 99 | 0 | 5 | 2.6 |

Ethoxylated phenols, 2, were also explored (Table 3). The most effective mixtures included longer EO chains and lower amounts of water.

2

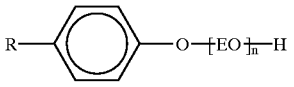

TABLE 3

Alkyl Phenol Surfactants.

| Exp. | Surfactant | R | n | pbw solvent | pbw surfactant | pbw water | ΔE |
|---|---|---|---|---|---|---|---|
| 74 | Triton X-405 | $C_9$ | 40 | 95 | 4 | 1 | 37.7 |
| 75 | | | 40 | 95 | 1 | 4 | 25.5 |
| 76 | | | 40 | 98 | 1 | 1 | 15.9 |
| 77 | Igepal CA-520 | $C_{12}$ | 5 | 95 | 4 | 1 | 4.4 |
| 78 | | | 5 | 95 | 1 | 4 | 10.0 |
| 79 | | | 5 | 98 | 1 | 1 | 2.3 |
| 80 | Igepal CO-850 | $C_9$ | 20 | 95 | 4 | 1 | 4.0 |
| 81 | | | 20 | 95 | 1 | 4 | 2.6 |
| 82 | | | 20 | 98 | 1 | 1 | 16.2 |

Glycol ethers and diols were also examined as additives to enhance the cleaning ability of the silicone solvent as seen in Table 4.

TABLE 4

Non-Ionic Ether and Diol Surfactants.

| Exp. No. | Surfactant | | pbw solvent | pbw surfactant | pbw water | ΔE |
|---|---|---|---|---|---|---|
| 83 | AZ7989 | di(ethyleneglycol)-2-ethylhexyl ether | 99 | 1 | — | 8.03 |
| 84 | | | 95 | 5 | — | 10.40 |
| 85 | | | 95 | 4 | 1 | 9.85 |
| 86 | | | 95 | 1 | 4 | 13.97 |
| 87 | | | 98 | 1 | 1 | 22.73 |
| 88 | AZ7988 | di(ethyleneglycol)hexyl ether | 99 | 1 | — | 8.89 |
| 89 | | | 95 | 5 | — | 9.13 |
| 90 | | | 95 | 4 | 1 | 33.40 |
| 91 | | | 95 | 1 | 4 | 16.64 |
| 92 | | | 98 | 1 | 1 | 24.02 |
| 93 | AZ7997 | 1,2-butanediol | 99 | 1 | — | 26.14 |
| 94 | | | 95 | 5 | — | 33.45 |
| 95 | | | 98 | 1 | 1 | 21.40 |
| 96 | AZ7998 | 1,2-decanediol | 99 | 1 | — | 11.26 |
| 97 | | | 95 | 5 | — | 29.54 |
| 98 | | | 98 | 1 | 1 | 11.55 |
| 99 | AZ7995 | 1,2-hexanediol | 99 | 1 | — | 10.01 |
| 100 | | | 95 | 5 | — | 28.56 |
| 101 | | | 95 | 5 | — | 15.7 |
| 102 | | | 98 | 1 | 1 | 32.51 |
| 103 | | | 99 | 1 | — | 21.40 |
| 104 | | | 98 | 1 | 1 | 14.85 |
| 105 | AZ7996 | 1,6-hexanediol | 99 | 1 | — | 7.47 |
| 106 | | | 95 | 5 | — | 5.16 |
| 107 | | | 98 | 1 | 1 | 31.78 |
| 108 | AZ7999 | 1,10-decanediol | 99 | 1 | — | 5.82 |
| 109 | | | 95 | 5 | — | 1.22 |
| 110 | | | 98 | 1 | 1 | 8.33 |

In the ether examples, optimal performance was seen with the addition of small amounts of water. The 1,2-diols were efficient at removing the dye at the 5% level, although significant cleaning was seen at 1% with water present. Table 5 shows the results from using sugar based surfactants and alkanol amides as water-based stain removers.

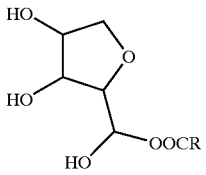

Span

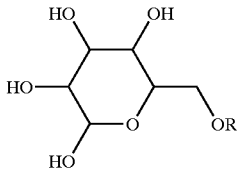

Glucopon

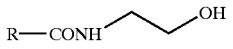

Alkamide

TABLE 5

Other Non-Ionic Surfactants.

| Exp. No. | Surfactant Trade Name | R | pbw solvent | pbw surfactant | pbw water | ΔE |
|---|---|---|---|---|---|---|
| 111 | Span-80 | Oleic | 95 | 4 | 1 | 3.7 |
| 112 | | | 95 | 1 | 4 | 2.4 |
| 113 | | | 98 | 1 | 1 | 5.2 |
| 114 | Glucopon 225* | $C_{8-10}$ | 95 | 1 | 4 | 4.7 |
| 115 | | | 95 | 4 | 1 | 31.2 |
| 116 | | | 98 | 1 | 1 | 5.8 |
| 117 | | | 99 | 1 | — | 10.8 |
| 118 | Glucopon 425** | $C_{8-16}$ | 95 | 1 | 4 | 32.5 |
| 119 | | | 95 | 4 | 1 | 36.2 |
| 120 | | | 98 | 1 | 1 | 19.0 |
| 121 | | | 99 | 1 | — | 3.9 |
| 122 | | | 95 | 5 | — | 19.6 |
| 123 | Glucopon 600*** | $C_{10-16}$ | 95 | 1 | 4 | 4.3 |
| 124 | | | 95 | 4 | 1 | 27.9 |
| 125 | | | 98 | 1 | 1 | 4.7 |
| 126 | | | 99 | 1 | — | 9.3 |
| 127 | Alkamide S-280 | Stearic | 95 | 5 | — | 8.37 |
| 128 | | | 99 | 1 | — | 1.72 |
| 129 | | | 98 | 1 | 1 | 1.96 |
| 130 | Alkamide CME | Coconut | 95 | 5 | — | 7.61 |
| 131 | | | 99 | 1 | — | 2.40 |
| 132 | | | 98 | 1 | 1 | 6.59 |

*30% water,
**50% water,
***50% water

The sorbitan oleate, as Span 80, was fairly ineffective as a cleaning additive, but the 6-membered glucoside materials (Glucopans) exhibited good cleaning power at the 4% level with additional water. The two alkanol amides performed poorly as cleaning surfactants in these tests.

Cationics

The cationic surfactants tested were all quaternary ammonium salts of the type 6 below. As one can see, the quat salts were effective at the 1% level in all cases. Additional water was sometimes advantageous.

6

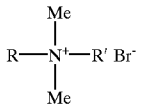

TABLE 6

Cationic Surfactants.

| Exp. No. | Surfactant | | pbw solvent | pbw surfactant | pbw water | ΔE |
|---|---|---|---|---|---|---|
| 133 | AZ7987 | Didecyldimethyl ammonium bromide | 99 | 1 | — | 16.55 |
| 134 | | | 95 | 5 | — | 15.44 |
| 135 | | | 95 | 4 | 1 | 4.78 |
| 136 | | | 95 | 1 | 4 | 10.36 |
| 137 | | | 98 | 1 | 1 | 10.88 |
| 138 | AZ7990 | Dihexadecyldimethyl ammonium bromide | 99 | 1 | — | 12.53 |
| 139 | | | 95 | 5 | — | 12.15 |
| 140 | | | 95 | 4 | 1 | 8.73 |
| 141 | | | 95 | 1 | 4 | 9.56 |
| 142 | | | 98 | 1 | 1 | 9.45 |
| 143 | AZ7991 | cetyltrimethylammonium bromide | 99 | 1 | — | 13.03 |
| 144 | | | 95 | 5 | — | 14.79 |
| 145 | | | 95 | 4 | 1 | 12.25 |
| 146 | | | 95 | 1 | 4 | 38.27 |
| 147 | | | 98 | 1 | 1 | 10.39 |
| 148 | | Vari-Soft 300 | 95 | 4 | 1 | 40.3 |
| 149 | | | 95 | 1 | 4 | 38.4 |
| 150 | | | 98 | 1 | 1 | 35.9 |
| 151 | 06955 | Ethoquad C/25 | 95 | 4 | 1 | 35.2 |
| 152 | | | 95 | 1 | 4 | 34.3 |
| 153 | | | 98 | 1 | 1 | 26.3 |
| 154 | | | 99 | 1 | — | 41.5 |
| 155 | | | 95 | 5 | — | 41.2 |

Vari-Soft 300: 30% $(C_{16})Me_3N^+Cl^-$: Ethoquad C/25: $C_{12-15}(Me)N((EO)_{25}H)_2{}^+Cl^-$

Amphoterics

The amphoteric materials examined were of the betaine class as illustrated below (table7). These were quaternized glycine derivatives. All these materials were supplied as aqueous solutions and performed moderately well at high levels and even better at lower, 1% loading.

7

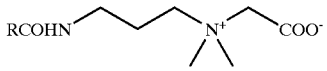

TABLE 7

Amphoteric Surfactants.

| Exp. No. | Surfactant | R | pbw solvent | pbw surfactant | pbw water | ?E |
|---|---|---|---|---|---|---|
| 156 | Mirataine COB* | Coco/oleo | 95 | 5 | — | 14.39 |
| 157 | | | 99 | 1 | — | 16.76 |
| 158 | | | 98 | 1 | 1 | 32.02 |
| 159 | Mirataine BET-C30** | Coco | 95 | 5 | — | 31.20 |
| 160 | | | 99 | 1 | — | 7.11 |
| 161 | | | 98 | 1 | 1 | 29.80 |

TABLE 7-continued

Amphoteric Surfactants.

| Exp. No. | Surfactant | R | pbw solvent | pbw surfactant | pbw water | ?E |
|---|---|---|---|---|---|---|
| 162 | Mirataine JC HA*** | | 95 | 5 | — | 33.76 |
| 163 | | | 99 | 1 | — | 24.95 |
| 164 | | | 98 | 1 | 1 | 32.09 |

*coca/oleamidopropyl betaine 30% in water,
**cocamidopropyl betaine 29% in water,
***amphoteric 50% in water

Anionics

A wide variety of organic anionic surfactants are available in the forms of sulfosuccinates, sulfonates, phosphonates and the like. One set examined were the sulfosuccinates as shown in Table 8. Best results were seen with high levels of added water. One beneficial feature of the Aerosol OT was that it was soluble in $D_5$ to at least 5 weight percent.

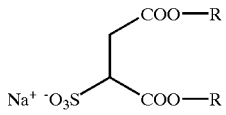

TABLE 8

Sulfosuccinates.

| Exp. | Surfactant Trade Name | R | mixture | pbw solvent | pbw surf | pbw water | ΔE |
|---|---|---|---|---|---|---|---|
| 165 | Aerosol TR | Tridecyl | — | 99 | 1 | — | 2.8 |
| 166 | | | — | 95 | 5 | — | 6.5 |
| 167 | Aerosol OT | Octyl | — | 99 | 1 | — | 1.6 |
| 168 | | | — | 95 | 5 | — | 2.3 |
| 169 | | | — | 95 | 4 | 1 | 6.9 |
| 170 | | | — | 95 | 1 | 4 | 20.3 |
| 171 | | | — | 98 | 1 | 1 | 7.5 |
| 172 | Aerosol GPG | Octyl | — | 99 | 1 | — | 3.0 |
| 173 | | | — | 95 | 5 | — | 3.0 |
| 174 | Aerosol TR/OT | | 50/50 | 99 | 1 | — | 1.5 |
| 175 | | | 50/50 | 95 | 5 | — | 2.5 |
| 176 | Aerosol TR/GPG | | 50/50 | 99 | 1 | — | 6.9 |
| 177 | | | 50/50 | 95 | 5 | — | 16.9 |
| 178 | Aerosol OT/GPG | | 50/50 | 99 | 1 | — | 4.6 |
| 179 | | | 50/50 | 95 | 5 | — | 6.7 |

Several phosphorous containing surfactants were tested as shown in Table 9. The ethoxylated phosphonates exhibited modest cleaning behavior while the lecithin-based surfactants did not remove the water soluble dye from the swatch.

TABLE 9

Phosphorous Containing Anionic Surfactants.

| Exp. No. | Surfactant Trade Name | Pbw Solvent | pbw surfactant | pbw water | ΔE |
|---|---|---|---|---|---|
| 180 | ATPHOS 3250 | 99 | 1 | — | 11.5 |
| 181 | | 95 | 5 | — | 12.3 |

TABLE 9-continued

Phosphorous Containing Anionic Surfactants.

| Exp. No. | Surfactant Trade Name | Pbw Solvent | pbw surfactant | pbw water | ΔE |
|---|---|---|---|---|---|
| 182 | | 95 | 4 | 1 | 7.9 |
| 183 | | 95 | 1 | 4 | 10.1 |
| 184 | | 98 | 1 | 1 | 13.5 |
| 185 | ATPHOS 3226 | 99 | 1 | — | 12.2 |
| 186 | | 95 | 5 | — | 11.4 |
| 187 | | 95 | 4 | 1 | 11.9 |
| 188 | | 95 | 1 | 4 | 6.8 |
| 189 | | 98 | 1 | I | 4.7 |
| 190 | YELKIN TS | 99 | 1 | — | 6.8 |
| 191 | | 95 | 5 | — | 20.7 |
| 192 | | 95 | 4 | 1 | 7.5 |
| 193 | | 95 | 1 | 4 | 8.2 |
| 194 | | 98 | 1 | 1 | 4.9 |
| 195 | Ultralec F | 99 | 1 | — | 1.9 |
| 196 | | 95 | 5 | — | 1.4 |
| 197 | | 95 | 4 | 1 | 1.7 |
| 198 | | 95 | 1 | 4 | 1.8 |
| 199 | | 98 | 1 | 1 | 3.3 |

ATPROS 3250: $C_{12}$—Ph—O—$(EO)_4$—$P_2O_5^-$;
ATPROS 3226: $C_{13}$—Ph—O—$(EO)_6$—$P_2O_5^-$;
Yelkin and Ultralec are lecithin based.

Alkyl and aryl sulfonates were also explored as surfactants for the silicone solvent. Table 10 shows the results of such materials, with and without additional water.

TABLE 10

Other Anionic Surfactants.

| Exp | Surfactant | Surfactant Trade Name | pbw solvent | pbw surfactant | pbw Water | ΔE |
|---|---|---|---|---|---|---|
| 200 | AZ6005 | Witconate AOS | 95 | 5 | — | 11.9 |
| 201 | | | 95 | 5 | — | 3.9 |
| 202 | | | 99 | 1 | — | 9.7 |
| 203 | | | 99 | 1 | — | 11.2 |
| 204 | | | 99 | 1 | — | 11.8 |
| 205 | | | 99 | 1 | — | 6.4 |
| 206 | | | 99 | 1 | — | 18.3 |
| 207 | | | 99 | 1 | — | 8.2 |

TABLE 10-continued

Other Anionic Surfactants.

| Exp | Surfactant | Surfactant Trade Name | pbw solvent | pbw surfactant | pbw Water | ΔE |
|---|---|---|---|---|---|---|
| 208 | 06417 | $C_{12}$—$SO_4^-Na^+$ | 99 | 1 | — | 2.7 |
| 209 | | | 95 | 5 | — | 3.4 |
| 210 | 06206 | Triton X-200 | 99 | 1 | — | 6.2 |
| 211 | | | 95 | 5 | — | 5.3 |
| 212 | | | 95 | 4 | 1 | 11.6 |
| 213 | | | 95 | 1 | 4 | 4.8 |
| 214 | | | 98 | 1 | 1 | 19.0 |
| 215 | 06651 | DDBSA | 99 | 1 | — | 51.5 |
| 216 | | | 95 | 5 | — | 50.4 |
| 217 | | | 95 | 4 | 1 | 52.3 |
| 218 | | | 95 | 1 | 4 | 47.4 |
| 219 | | | 98 | 1 | 1 | 49.1 |
| 220 | 067751 | Bio-Soft D-62 | 95 | 4 | 1 | 2.9 |
| 221 | | | 95 | 1 | 4 | 28.4 |
| 222 | | | 98 | 1 | 1 | 14.3 |

Triton X-200: $C_{12}$—Ph—O—$(EO)_3$—$OSO_3^-Na^+$;
Witconate AOS: $C_{14-16}$—$SO_4^-Na^+$;
Bio-Soft D-62: Na DDBSA, 50%.

Fluoro-surfactants were also examined as shown in Table 11. Of all the varieties tried, the fluorinated quat salts and the fluoroalkyl alkoxide displayed the best performance.

TABLE 11

Fluoro-Surfactants.

| Exp. No. | Surfactant Trade Name | Type | pbw solvent | pbw surfactant | pbw water | ΔE |
|---|---|---|---|---|---|---|
| 223 | Fluorad FC-120 | $F_{2n+1}C_nSO_3^-NR_4^+$ | 99 | 1 | — | 8.5 |
| 224 | Fluorad FC-120 | | 98 | 1 | 1 | 8.1 |
| 225 | Fluorad FC-129 | $F_{2n+1}C_nCOO^-K^+$ | 99 | 1 | — | 1.9 |
| 226 | Fluorad FC-129 | | 98 | 1 | 1 | 7.4 |
| 227 | Fluorad FC-135 | $(F_{2u+1}C_u)_4N^+I^-$ | 99 | 1 | — | 13.0 |
| 228 | Fluorad FC-135 | | 98 | 1 | 1 | 31.9 |
| 229 | Fluorad FC-170C | $F_{2n+1}C_u$—$(EO)_3$—H | 99 | 1 | — | 10.6 |
| 230 | Fluorad FC-170C | | 98 | 1 | 1 | 13.0 |
| 231 | Fluorad FC-171 | $F_{2n+1}C_n$—OR | 99 | 1 | — | 7.5 |
| 232 | Fluorad FC-171 | | 98 | 1 | 1 | 21.7 |
| 233 | Fluorad FC-430 | $F_{2n+1}C_n$—COOR | 99 | 1 | — | 10.9 |
| 234 | Fluorad FC-430 | | 98 | 1 | 1 | 10.4 |
| 235 | Fluorad FC-740 | $F_{2u+1}C_n$—COOR | 99 | 1 | — | 2.2 |
| 236 | Fluorad FC-740 | | 98 | 1 | 1 | 3.9 |
| 237 | Dynol 604 | $F_{2n+1}C_nSO_2N(Et)CH_2COO^-K^+$ | 99 | 1 | — | 7.1 |
| 238 | Dynol 604 | | 98 | 1 | 1 | 1.2 |

The present invention exhibits improved performance of dry cleaning agents for stain removal, particularly water soluble stains, through the addition of a surfactant, and optionally water.

What is claimed is:

1. A dry cleaning composition, comprising a volatile cyclic, linear or branched siloxane, or combination thereof, comprising from about 90 to about 99.99 parts by weight of the volatile siloxane, and from about 0.001 to less than 10 parts by weight of one or more organic surfactants.

2. A dry cleaning composition, comprising a volatile cyclic, linear or branched siloxane, or combination thereof, comprising from about 90 to about 99.99 parts by weight of the volatile siloxane, and from about 0.001 to less than 10 parts by weight of one or more organic surfactants.

* * * * *

UNITED STATES PATENT AND TRADEMARK OFFICE

CERTIFICATE OF CORRECTION

PATENT NO. : 6,521,580 B2 
DATED : February 18, 2003
INVENTOR(S) : Perry et al.

It is certified that error appears in the above-identified patent and that said Letters Patent is hereby corrected as shown below:

Column 22,
Line 60, Claim 2 should read:
-- 2. The composition of Claim 1, further comprising from about 0.01 to about 15 parts by weight of water. --

Signed and Sealed this

Seventeenth Day of June, 2003

JAMES E. ROGAN
*Director of the United States Patent and Trademark Office*